US008846216B2

(12) United States Patent
Jabado et al.

(10) Patent No.: US 8,846,216 B2
(45) Date of Patent: Sep. 30, 2014

(54) CAST PIECE AND METHOD FOR PRODUCING SAME

(75) Inventors: Rene Jabado, Berlin (DE); Jens Dahl Jensen, Berlin (DE); Ursus Krüger, Berlin (DE); Daniel Körtvelyessy, Berlin (DE); Richard Matz, Bruckmühl (DE); Ralph Reiche, Berlin (DE); Michael Rindler, Schöneiche (DE); Steffen Walter, Oberpframmern (DE)

(73) Assignee: Siemens Aktiengesellschaft, Munich (DE)

( * ) Notice: Subject to any disclaimer, the term of this patent is extended or adjusted under 35 U.S.C. 154(b) by 1189 days.

(21) Appl. No.: 12/308,732

(22) PCT Filed: Jun. 19, 2007

(86) PCT No.: PCT/EP2007/056084

§ 371 (c)(1),
(2), (4) Date: Sep. 28, 2009

(87) PCT Pub. No.: WO2008/000660

PCT Pub. Date: Jan. 3, 2008

(65) Prior Publication Data

US 2010/0035084 A1 Feb. 11, 2010

(30) Foreign Application Priority Data

Jun. 27, 2006 (DE) ..... 10 2006 030 365

(51) Int. Cl.

| | |
|---|---|
| ***G11B 5/74*** | (2006.01) |
| ***B22D 27/02*** | (2006.01) |
| ***B22D 19/00*** | (2006.01) |
| ***B22D 46/00*** | (2006.01) |
| ***B22D 45/00*** | (2006.01) |

(52) U.S. Cl.

CPC ..... *B22D 19/00* (2013.01); *B22D 46/00* (2013.01); *B22D 45/00* (2013.01)

USPC ..... 428/692.1; 428/558; 428/610; 428/611; 428/615; 428/212; 164/498

(58) Field of Classification Search

None

See application file for complete search history.

(56) References Cited

U.S. PATENT DOCUMENTS

| | | | | |
|---|---|---|---|---|
| 1,561,427 | A | 11/1925 | Forsberg | |
| 4,161,830 | A | 7/1979 | Gentil | |
| 6,189,413 | B1 * | 2/2001 | Morse et al. | 74/607 |
| 2002/0114701 | A1 * | 8/2002 | Coulson | 416/241 R |
| 2005/0017082 | A1 * | 1/2005 | Moran et al. | 235/493 |
| 2006/0024531 | A1 * | 2/2006 | Murakami | 428/827 |
| 2007/0072006 | A1 * | 3/2007 | Deevi et al. | 428/692.1 |

FOREIGN PATENT DOCUMENTS

| | | | |
|---|---|---|---|
| CH | 683073 | A5 | 1/1994 |
| DE | 199 25 674 | A1 | 7/2000 |

(Continued)

OTHER PUBLICATIONS

Englsih Translation of EP 1675040 A1 (published 2006).*

*Primary Examiner* — Kevin Bernatz

(57) ABSTRACT

A method for producing a cast metal piece and a cast metal piece are provided. An information element includes at least one piece of information. The information element is produced from a magnetizable material and the information is deposited n the magnetizable material and is cast into the information element during casting of the price, the casting temperature being above the Curie temperature of the magnetizable material of the information element.

9 Claims, 1 Drawing Sheet

(56) References Cited

FOREIGN PATENT DOCUMENTS

| | | | | |
|---|---|---|---|---|
| DE | 102 07 279 | A1 | | 10/2002 |
| EP | 1 675 040 | A1 | | 6/2006 |
| EP | 1675040 | A1 | * | 6/2006 |
| JP | 10154218 | A1 | | 6/1998 |
| WO | WO 92/11102 | A1 | | 7/1992 |
| WO | WO 2004025548 | A1 | * | 3/2004 |
| WO | WO 2005/008294 | A1 | | 1/2005 |

* cited by examiner

CAST PIECE AND METHOD FOR PRODUCING SAME

CROSS REFERENCE TO RELATED APPLICATIONS

This application claims priority of German application No. 10 2006 030 365.2 DE filed Jun. 27, 2006, which is incorporated by reference herein in its entirety.

FIELD OF INVENTION

The invention relates to a method for producing a cast piece and to a cast piece.

BACKGROUND OF INVENTION

As is known, cast metal pieces for machines, for example turbine blades for gas turbines, are provided with information elements in order to be able to unambiguously identify the cast pieces as part of servicing or cleaning work or in the case of guarantee claims. A number of technical aspects must be taken into account when attaching information elements of this kind. On the one hand, the information elements must not cause interference or be damaged during subsequent use of the cast piece, and on the other, it must be ensured that it is impossible or at least very troublesome to falsify or corrupt the information elements retrospectively. The aim must be to store the information so securely that a financial gain that may possibly be fraudulently obtained by falsifying the information elements is negated by the high falsification effort necessary, so that accordingly falsification is not worthwhile.

Publication DE 102 07 279 discloses a method for producing a gas turbine blade in which a part identification number is embossed directly into the surface of the gas turbine blade by appropriate shaping of a mould. The corresponding surface section of the gas turbine blade thus forms an information element, which carries the part identification number as information.

U.S. Pat. No. 1,561,427 discloses a method for inscribing a cast piece in which characters made from a material with a higher melting temperature than the melting temperature of the cast piece are cast into said cast piece when it is produced.

U.S. Pat. No. 4,161,830 discloses a method for inscribing a cast piece. With this method, characters made from a heat-resistant material with a dovetail shape—viewed in cross section—are each bonded to a holding magnet. The resulting units are each fixed to the wall of a mould, the holding forces being produced by the holding magnets. The characters are then cast into the cast piece by filling the mould with a casting material.

SUMMARY OF INVENTION

Starting from a method of the kind specified in the introduction, the invention is based on the object of specifying a method for producing a cast piece with an information element which can easily be carried out and which provides a particularly high measure of security against corruption of the information of the information element.

According to the invention, this object is achieved starting from the independent claims pertaining to a method.

A significant advantage of the method according to the invention can be seen in that, with said method, cast pieces can be characterized as being very secure against falsification. This is due primarily to the fact that the information element is cast into the cast piece and is therefore invisible from the outside. Only the manufacturer of the cast piece knows that such an information element is contained within the cast piece, and only he knows the exact position of the information element to be able to read it out retrospectively. Third parties, for example purchasers or users of the cast piece, are therefore not easily able to access the information element and read it out.

A further significant advantage of the method according to the invention consists in that corruption of the information element is effectively ruled out, or is at least very difficult, as the information element is cast into the cast piece and is therefore embedded. Replacing or exchanging the information element would make it necessary to specifically melt open at least a section of the cast piece in order to be able to access the information element embedded therein. Such melting open is very elaborate, however, so that this would not usually be worthwhile for economic reasons, and attempts at falsification would be uninteresting.

A further significant advantage of the method according to the invention consists in that a casting temperature above the Curie temperature of the magnetizable material of the information element is used during the casting of the cast piece. Due to this high temperature, the magnetizable material loses its magnetic properties so that the information stored or deposited in the magnetizable material cannot be read without subsequently remagnetizing the information element. In order to be able to access the information element, an unauthorized third party would therefore have to first of all know that an information element was actually present, where exactly it was fitted and also that "remagnetization" of the information element would be necessary first to enable the information contained therein to be read out.

If it is not desired to "hide" the information element and the information contained therein, and it is to be guaranteed that the information can be read out easily, then it is seen to be advantageous when, on completion of the casting process of the cast piece, the magnetizable material is retrospectively magnetized to enable the information of the information element to be read out immediately, for example with a magnet head reader or similar.

The information can be stored by making recesses, for example, in particular depressions or holes, in the magnetizable material, or by removing magnetizable material depending on the location. Preferably, a type of punched card structure is made in the magnetizable material in which logic ones and logic zeros are stored by means of a hole coding system. Such hole coding can be produced, for example, by drilling holes or depressions in the magnetizable material. At the same time, the holes or depressions can be formed by means of a normal drilling process with a drill, by laser material removal or by chemical or electro-chemical etching.

For reasons of space, it is seen to be advantageous when the hole structure is designed to be two-dimensional and forms a two-dimensional matrix.

The recesses or holes can, for example, be filled with a non-magnetizable material in order to effect the largest possible difference between the magnetic properties of the magnetizable material and the area of the recesses or holes. Alternatively, a further magnetizable material, which has different magnetic properties from the remaining magnetizable material, can also be used instead of a non-magnetizable material.

Furthermore, the information can also be stored in the information element by arranging at least two materials with different magnetizability in different zones of the information element while forming a coding system. With this embodiment, it is therefore not necessary to form holes or recesses within the magnetizable material, but instead two different materials are used from the very beginning and arranged differently locally in order to form a coding system—preferably as part of a matrix—and to deposit the information.

The information is preferably stored in binary form within the information element in order to enable it to be read out as reliably and as free from interference as possible.

In order to ensure that the information stored in the information element can only be read out by such persons that are authorized to do so, it is seen to be advantageous when the information is stored in the magnetizable material in encrypted form. Preferably, for this purpose, the magnetizable material is divided into at least two sections, namely into a first section in which a coding key is stored which is required for encrypting useful information, and into a second section in which at least the useful information is stored in encrypted form using the coding key. With regard to the greatest possible information density, it is also seen to be advantageous here when both the first section and the second section are designed two-dimensionally in matrix form.

In order to guarantee that the magnetizable material is protected during the casting process, it is seen to be advantageous when the magnetic material is embedded between two ceramic layers which have a high temperature stability before the casting process starts.

In particular, in the case of very high-quality cast pieces, such as turbine blades for example, the application of identification numbers and other information such as the manufacturing location, the time of manufacture, the manufacturing parameters and the manufacturer, is important to enable specific maintenance of the component and to extend its life. For this reason, it is seen to be advantageous when machine components, in particular turbine parts such as turbine blades, are produced in accordance with the described method.

In addition, the invention relates to a cast piece, especially a cast metal piece, with an information element carrying at least one piece of information.

According to the invention, features of the independent claim for a cast piece are provided in order to guarantee the highest degree of security against corruption of the information contained in the information element when using such a cast piece.

BRIEF DESCRIPTION OF THE DRAWINGS

The invention is described in more detail below with reference to an exemplary embodiment. By way of example

DETAILED DESCRIPTION OF INVENTION

Figure 1:
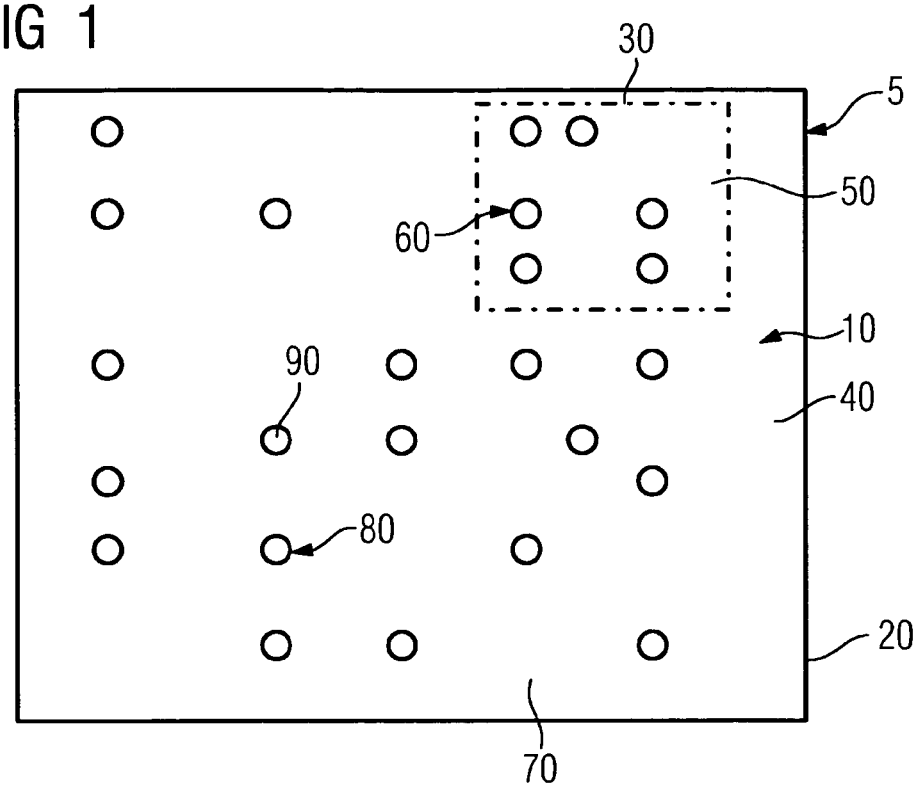
FIG. 1 shows an exemplary embodiment of an information element which is suitable for casting into a cast piece.
Figure 2:
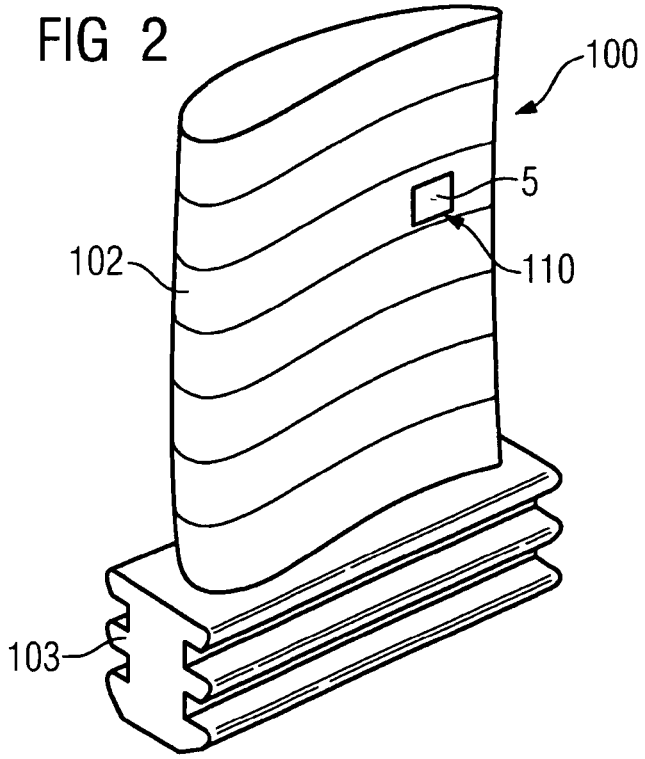
FIG. 2 shows an exemplary embodiment of a finished cast piece in which the information element according to FIG. 1 is cast.

In FIGS. 1 and 2, the same references are always used for identical or similar components for reasons of clarity.

An information element 5 with a magnetizable material 10 in the form of a magnetizable ceramic plate 20 which is divided into two sections 30 and 40 can be seen in FIG. 1.

A coding key 50 in the form of a hole structure 60 is stored in the first section 30. The hole structure 60 is designed in two dimensions and forms a matrix in order to achieve minimum space requirement and maximum information density.

Useful information 70 in the form of a further hole structure 80, which however is encrypted, is stored in the second section 40. In order to be able to understand the useful information 70 of the second section 40, it is necessary to use the coding key 50 from the first section 30 and a further complimentary coding key for decryption. The further complimentary coding key is not contained in the magnetizable material 10 and is also not stored in the information element; it is only known to the manufacturer of the information element who keeps this secret and only makes it accessible to such persons that are to be authorized to read out the useful information from the second section 40. The coding key 50 and the further coding key which is not contained in the information element preferably form a key pair, with which the further coding key cannot be derived from the coding key 50 as is generally known in the field of encryption technology.

The hole structure 60 and the further hole structure 80 are preferably formed by making recesses or holes 90 in the magnetizable material 10. The recesses or holes can be formed in the ceramic plate 20 and therefore in the magnetizable material 10 by drilling, laser material removal or by chemical or electro-chemical etching.

Because the hole structure 60 and the further hole structure 80 are formed in the ceramic plate 20 by mechanical means, the information formed by the two hole structures is permanently written in the magnetizable material 10 so that it cannot be lost, regardless of whether the magnetizable material 10 is magnetized or not magnetized. If, as part of further processing, the information element is now subjected to a temperature which lies above the Curie temperature of the magnetizable material 10, then although any already existing magnetization of the magnetizable material 10 is lost, the information itself is mechanically permanently written in the form of the two hole structures 60 and 80 so that it cannot be lost.

The ceramic plate 20 can be embedded between two further dielectric ceramic plates as part of a sandwich structure, for example, in order to protect it from the liquid casting material during the casting process. The two further ceramic plates are not shown in FIG. 1 for reasons of clarity.

A cast piece 100 in the form of a turbine blade with a blade 102 and a root 103 can be seen in FIG. 2 in a three-dimensional representation. The information element 5 according to FIG. 1 is cast into the cast piece 100 at a specified position 110. In the example in FIG. 2, the information element 5 is cast into the blade 102; alternatively it can also be cast into the root 103 which under certain circumstances is to be preferred in the individual case for reasons of stability.

The information element 5 is located within the cast piece 100 and can therefore not be seen directly from the outside. As a temperature which lies above the Curie temperature of the magnetizable material 10 of the information element 5 is used when manufacturing the cast piece 100, neither the useful information 70 nor the coding key 50 can be read out directly from the outside.

It is therefore first of all necessary to magnetize the information element 5 in order to be able to read out the hole structures 60 and 80 contained in the magnetizable material 10, for example using magnetic means. When such a retrospective magnetization has been carried out, the hole structures 60 and 80 contained in the magnetizable material 10 can be detected with the help of a magnet head reader and therefore both the coding key 50 and the useful information 70 can be read out.

If the person reading out the information is an authorized person, then he will be in possession of the complimentary coding key to the coding key 50 and therefore be in a position to decrypt and understand the coded useful information 70.

If, on the other hand, the person reading out the information is not authorized to do so, then he will not have the further complimentary coding key and therefore not be in a position to decrypt the useful information 70.

In summary, it must be asserted that the information element 5 located in the cast piece 100 is very difficult to read out or corrupt by unauthorized persons, as it is not immediately accessible from the outside and an additional coding key, which is not known to unauthorized persons, is required to understand the information contained therein.

As already mentioned, the hole structures 60 and 80 can be read out by magnetic means using a magnet head reader or similar; alternatively, it is also conceivable to use an electrical eddy current method with which eddy currents are specifically generated in the magnetizable material 10 which in turn produce magnetic fields and enable both the coding key 50 and the useful information 70 to be read out.

Instead of a magnetizable ceramic plate 20, the information element 5 can also be equipped with a "normal" ferrite layer which forms the magnetic material 10 of the information element 5.

As the useful information 70 and the coding key 50 are stored in the magnetizable material 10 by means of mechanical hole structures, the information element 5 is resistant to high temperatures, as a loss of information can only occur when temperatures above the melting temperature of the magnetizable material 10 are reached or are exceeded and the hole structures 60 and 80 disappear due to melting. As long as the melting temperature is not reached, the stored information remains available and readable even when the Curie temperature of the magnetizable material is exceeded and the magnetizable material 10 as such becomes non-magnetic; reading out the two hole structures 60 and 80 can be made possible once more by simple retrospective magnetization or remagnetization, which can easily be carried out by applying a magnetic field from the outside for example.

The invention claimed is:

1. A cast metal piece, comprising:

an information element made of a magnetizable material, wherein a piece of information is stored by providing holes or bores into the magnetizable material, wherein the information element is cast into the cast metal piece, wherein a temperature above the Curie temperature of the magnetizable material of the information element is used for the casting, wherein the piece of information is stored after the magnetizable material has been heated to a temperature above the Curie temperature of the magnetizable material such that the information remains un-readable directly from outside, and wherein the information element is completely encapsulated by the cast metal piece.

2. The cast metal piece as claimed in claim 1, wherein the magnetizable material of the information element is remagnetizable in the presence of a magnetic field, wherein the piece of information is readable upon said remagnetization.

3. The cast metal piece as claimed in claim 1, wherein the holes or bores are filled with a non-magnetizable material whereby a difference between the magnetic properties of the magnetizable material and the area of the holes or bores are effected.

4. The cast metal piece as claimed in claim 1, wherein the piece of information is stored in the information element by arranging at least two materials with different magnetizability in different zones of the information element while forming a coding system.

5. The cast metal piece as claimed in claim 1, wherein the information is stored in binary form.

6. The cast metal piece as claimed in claim 1, wherein the at least a portion of the piece of information is stored in the magnetizable material in encrypted form.

7. The cast metal piece as claimed in claim 6, wherein the magnetizable material is divided into a plurality of sections that comprises a first section and a second section, wherein the piece of information includes a coding key and a data element wherein the coding key is required for encrypting the data element and is stored in the first section, and wherein the data element is stored in encrypted form using the coding key in the second section.

8. The cast metal piece as claimed in claim 1, wherein the cast metal piece is a turbine part or a turbine blade.

9. A cast metal piece, comprising:

an information element made of a magnetizable material, wherein a piece of information is stored by providing holes or bores into the magnetizable material, wherein the information element is cast into the cast metal piece, wherein a temperature above the Curie temperature of the magnetizable material of the information element is used for the casting, and wherein the piece of information is stored after the magnetizable material has been heated to a temperature above the Curie temperature of the magnetizable material such that the information remains un-readable directly from outside, wherein the magnetizable material is embedded between and directly in contact with two ceramic layers.

* * * * *